United States Patent [19]

Pagdin

[11] Patent Number: 4,705,219

[45] Date of Patent: Nov. 10, 1987

[54] ELECTROMAGNETICALLY-OPERABLE FLUID INJECTORS

[75] Inventor: Brian C. Pagdin, Dunstable, England

[73] Assignee: Solex (UK) Limited, England

[21] Appl. No.: 778,961

[22] Filed: Sep. 23, 1985

[51] Int. Cl.[4] ..... F02M 51/08

[52] U.S. Cl. ..... 239/397.5; 137/468; 239/585; 251/129.14; 251/129.18

[58] Field of Search ..... 137/468; 251/129.14, 251/129.18, 129.15; 239/397.5, 585

[56] References Cited

U.S. PATENT DOCUMENTS

| | | | |
|---|---|---|---|
| 2,371,122 | 3/1945 | Armstrong | 137/468 X |
| 2,909,032 | 10/1959 | Davies | 137/468 X |
| 2,974,944 | 3/1961 | Terp | 137/468 X |
| 4,449,548 | 5/1984 | Tutherly | 137/468 |

FOREIGN PATENT DOCUMENTS

| | | | |
|---|---|---|---|
| 63952 | 11/1982 | European Pat. Off. | 239/585 |
| 409039 | 8/1974 | U.S.S.R. | 137/468 |

*Primary Examiner*—Andres Kashnikow
*Attorney, Agent, or Firm*—Parkhurst & Oliff

[57] ABSTRACT

An electromagnetically-operable fuel injector comprising a fuel chamber having an outlet nozzle and into which a solenoid core projects. A ball valve in the gap between the core and the nozzle orifice and movable towards and away from the core to seat and unseat a valve seat around the nozzle orifice by energization of an electromagnetic circuit. Compensating structure is provided which respond to changes in temperature by changing a physical characteristic. The compensating structure function either to change the length of the core or to adjust the position of the valve seat relative to the core such that any tendency for fuel metering characteristics of the injector to be changed by a change in temperature in the injector is countered whereby operation of the injector to inject fuel is substantially independent of temperature change.

8 Claims, 4 Drawing Figures

ELECTROMAGNETICALLY-OPERABLE FLUID INJECTORS

DESCRIPTION

This invention relates to electromagnetically-operable fluid injectors and particularly, although not exclusively, to electromagnetically-operable fuel injectors.

Operation of electromagnetically-operable fluid injectors is controlled by an electronic control arrangement which is fed signals indicative of various sensed parameters which influence that operation. One of the attractions of the use of electromagnetically-operable injectors in fuel injection systems is the ability to incorporate corrections to cope with variations in the various parameters that influence operation of the engine in the electrical signal that effects energisation of the injector, since the electronic control arrangement can readily be fed signals indicative of a variety of sensed parameters which influence operation of the engine, e.g. speed, temperature, manifold pressure, etc. That facility has become all the more attractive with the availability of appropriate microprocessors which may include a data store, such as a memory matrix, which can be programmed to store data comprising optimum fuel flow rates for a wide range of different sensed engine parameters such as temperature, atmospheric pressure, engine speed and engine inlet manifold pressure which is representative of engine loading.

An object of this invention is to cater for the effect of temperature changes on fluid flow rate in an electromagnetically-operable fluid injector.

According to this invention there is provided an electromagnetically-operable fluid injector comprising a hollow body which carries an injector nozzle which forms a nozzle orifice, a chamber which is formed by the hollow interior of the body, a valve, a valve seat with which the valve cooperates such that communication between the chamber and the nozzle orifice is allowed when the valve is unseated and is blocked when the valve is seated, a solenoid core which projects into the chamber opposite the valve seat, and a solenoid winding wound around the core, the valve being located in a gap in a magnetic circuit which is formed by the body, including the core, and which is magnetised by energisation of the solenoid winding, wherein means which respond to changes in temperature to which they are subjected by changing a physical characteristic thereof, are provided in the injector so that they cooperate with one of the valve and the valve seat such that any tendency for fluid flow metering characteristics of the injector to be changed by a change in the temperature in the injector is countered whereby operation of the injector to inject fluid is substantially independent of temperature change.

Preferably the stroke of movement of the valve relative to the valve seat is changed with a change in temperature by virtue of a consequent change in the physical form of said means which causes a change in the distance between the solenoid core and the valve seat.

In one embodiment of this invention such variation in the stroke of the valve is achieved by the use of a telescopic assembly as the solenoid core, one part of the solenoid core, viz. that part that is nearer to the valve seat, being guided for rectilinear movement towards and away from the valve seat by a static part of the solenoid core, which is mounted in the hollow body, and being connected to the static part by a connecting piece of a material having a different coefficient of expansion from that of the material from which the static part is formed such that said one part is caused to move relative to said static part by the effects of the differential expansion of the connecting piece relative to the static part.

In another embodiment of this invention, such variation in the stroke of the valve is achieved by forming the valve seat on a member which is slidably mounted in the body and guided for rectilinear movement by the body relative to the solenoid core, the thermally-responsive means reacting against the body and acting on the member in opposition to the action of resilient means which provide a restoring force. The thermally-responsive means may comprise a portion of plastics material having a suitable coefficient of expansion, or may comprise a bimetallic element which may be in the form of a disc spring.

Three embodiments of this invention are described now by way of example with reference to the accompanying drawings, of which:

Figure 1:
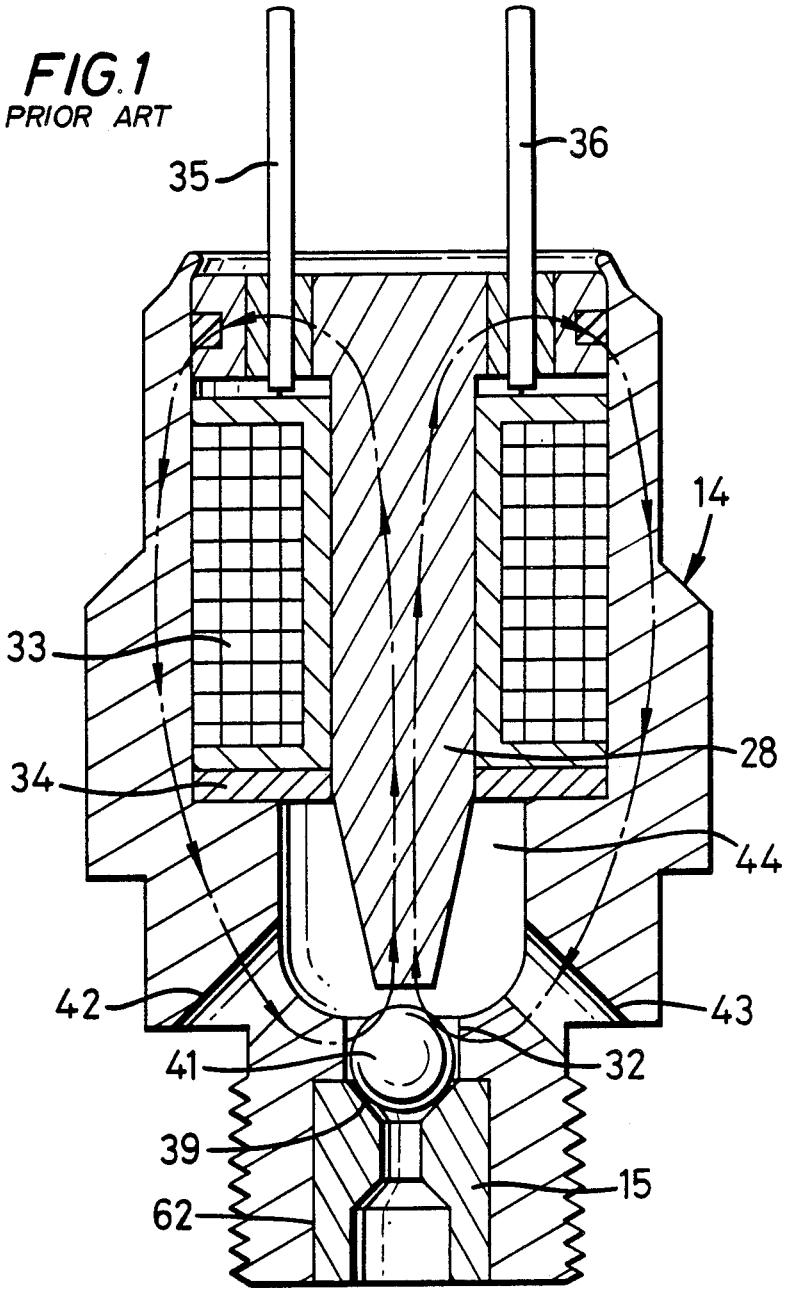
FIG. 1 PRIOR ART
FIG. 1 is a transverse cross-section of an electromagnetically-operable fuel injector which does not embody the present invention but which could be modified to incorporate either of the three embodiments of this invention which are illustrated in FIGS. 2, 3 and 4.

The fuel injector shown in FIG. 1 is described and claimed in the description and claims of our European patent application No. 82302154.8 (Publication EPA No. 0063952) and in U.S. Pat. No. 4,531,679. It comprises a hollow body 14 of magnetic material which carries an injector nozzle 15.

A solenoid winding 33 is mounted within the interior of the hollow body 14. It surrounds a solenoid core 28. A chamber 44 is formed between the solenoid winding 33 and the injector nozzle 15. The end portion of the solenoid core 28 that projects into the chamber 44 opposite the injector nozzle 15, with which it is coaxial, is tapered and serves as a flux concentrating pole piece. Terminal pins 35 and 36 extend from the solenoid winding 33, to which they are connected, and are for connection to an appropriate electrical control circuit (not shown).

The injector nozzle 15 is formed of a non-magnetic material. It forms a tapered valve seat 39 around a nozzle orifice at its end nearer to the solenoid core 28.

A ball valve 41 is located in an open ended bore 32 formed by the body 14 between the chamber 44 and the injection nozzle 15. The diameter of the ball valve 41 is less than that of the bore 32. The distance between the injection nozzle 15 and the adjacent end of the solenoid core 28 is such that the ball valve 41 is spaced from the solenoid core 28 when it is seated on the valve seat 39. The length of the bore 32 is such that the equator of the ball 41 is always located within that bore 32. The ball valve 41 is a moving part of a magnetic circuit formed by the body 14 and the solenoid core 28 by energisation of the solenoid winding 33, and is located in a gap in that magnetic circuit by virtue of its being located in the bore 32 and between the valve seat 39 and the solenoid core 28.

Passages 42 and 43 in the body 14 communicate with the chamber 44 and serve as ports by which that chamber 44 is connected into the fuel system. It is desirable that the volume of the chamber 44 is as small as is practicable in order to minimise the instance of fuel vapour forming and being trapped therein. It is also desirable for the inner ends of the passages 42 and 43 to be as close as is practicable to the bore 32 in order to reduce the risk of fuel vapour passing through that bore to the nozzle orifice. Furthermore, for high frequency operation, it is desirable for the stroke of movement of the ball valve 41 between the solenoid core 28 and the valve seat 39, to be as small as practicable without interfering with the metered fuel flow passed the ball valve 41 and through the nozzle orifice, and also without interfering with the facility for varying its length automatically with changes in temperature to compensate for those temperature changes, as is described below.

A coil spring (not shown), which reacts against the solenoid core 28, may be provided to urge the ball valve 41 to seat on the valve seat 39. Such a spring would be provided if the fuel injector 14 is used in a fuel system which operates at a pressure too low for it to be sufficiently certain that the ball valve 41 can be seated by the fluid flow forces acting on it, without the aid of such a spring.

Figure 2:
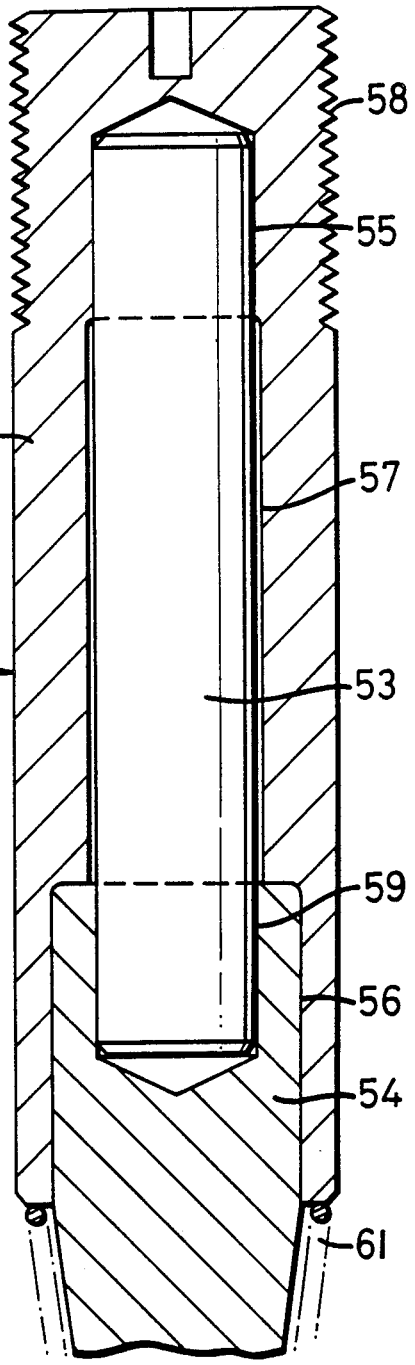
FIG. 2 is a cross-section of the solenoid core assembly of one form of fuel injector in which this invention is embodied.

FIG. 2 shows a solenoid core assembly 51 for use in the fuel injector 14 in place of the solenoid core 28. The solenoid core assembly 51 comprises an elongate, cylindrical, steel body 52, a constant section, cylindrical, aluminium bar 53 and a steel pole piece 54.

The elongate body 52 has a blind, stepped, axially-extending bore formed in it. The stepped bore is in three portions. The smallest diameter bore portion 55 is at the closed end. The largest diameter bore portion 56 is at the open end. The medial diameter bore portion 57 extends between the two end bore portions 55 and 56 and is only slightly larger in diameter than the smallest diameter bore portion 55. A screw thread 58 is formed on the outer cylindrical surface of the body 52 at the closed end and serves for screwing the solenoid core assembly 51 into the body 14 of the fuel injector.

One end of the aluminium bar 53 is spigotted into the smallest diameter bore portion 55. The bar 53 extends through the medial diameter bore portion 57, with a small clearance therearound, and projects into the larger diameter bore portion 56 where it is spigotted into a blind bore 59 which is formed in the pole piece 54. The part of the pole piece 54 that is within the largest diameter, end bore portion 56 is cylindrical and is a sliding fit in that end bore portion 56. The remainder of the pole piece 54, that projects outwards from the end bore portion 56, is tapered and serves as the flux concentrating portion of the pole piece 54.

An annular end surface formed by the body 52 around the mouth of the end bore portion 56 from which the pole piece 54 projects, serves as a reaction surface for a spring 62 which is provided to seat the ball valve 41 when required.

The solenoid core assembly 51 is assembled with the aluminium bar 53 in compression. Assembly may be carried out in a low temperature environment.

Variation in the temperature of the fuel in the chamber 44 and/or of the body 14 of the fuel injector effects differential expansion of the aluminium bar 53 and the cylindrical body 52, and thus effects rectilinear sliding movement of the pole piece 54 relative to the cylindrical body 52. Such rectilinear sliding movement of the pole piece 54 changes the length of the stroke of movement of the ball valve 41 and thereby compensates for local temperature changes which would not be detected and/or compensated for by the electronic control system. Assembly of the solenoid core assembly 51 with the aluminium bar 53 in compression, and under cold conditions, enables movement of the pole piece 54 relative to the body 52 in either direction and also provides for return movement.

Figure 3:
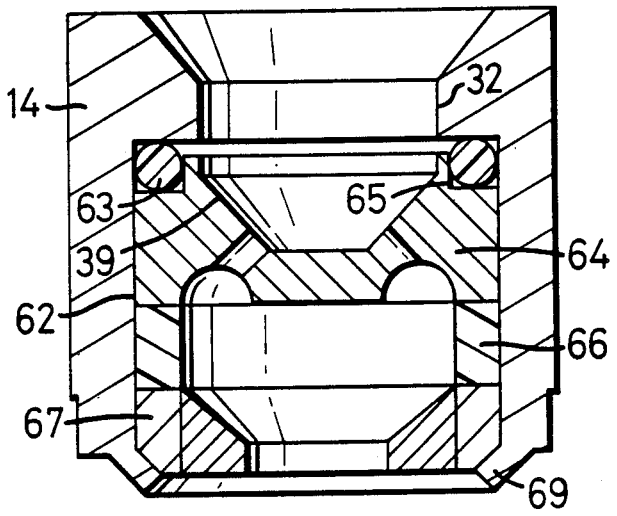
FIG. 3 is a cross-section of an injector nozzle assembly of another form of fuel injector in which this invention is embodied.

FIG. 3 shows an alternative form of injection nozzle assembly for fitting, in place of the injection nozzle 15, in the end bore 62 that is adjacent the downstream end of the bore 32 and that has a larger diameter than the bore 32. An O-ring 63 of elastomeric material is inserted in the bore 62 and placed against the radial wall at the end of that bore 62 adjacent the bore 32. A circular nozzle body 64 is placed in a sliding fit in the end bore 62. It forms the tapered valve seat 39, but has nozzle orifices formed in it on a pitch circle around the axis. Each nozzle orifice has its axis oblique to the axis of the nozzle body 64, the axes of the nozzle orifices diverging in the direction of flow through the nozzle body 64. An annular recess 65 is formed in the nozzle body 64 at the end of its outer cylindrical surface nearer the bore 32. The axial depth of the annular recess 65 is less than the diameter of the O-ring 63 and the latter, which projects into the recess 65, is normally in its natural relaxed state. A tubular bush 66 of a plastics material having a different coefficient of expansion from the non-magnetic material of the nozzle body 64, separates the nozzle body 64 from an end bush 67 which is retained in position within the bore 62 by a peened-over portion 69 of the body 14.

An increase in temperature of the fuel flowing through the nozzle body 64, and/or of the body 14 of the injector, causes axial expansion of the plastic bush 66 which urges the nozzle body 64 axially to compress the O-ring 63. The nozzle body 64 is returned on cooling of the fuel and/or the body 14, due to the resilience of the material of the O-ring 63. Hence the distance between the seat 39 and the core 28 is varied with local changes in temperature. Such local temperature changes, which would not be detected or compensated for by the electronic control system, are compensated for by such movement of the seat 39.

Figure 4:
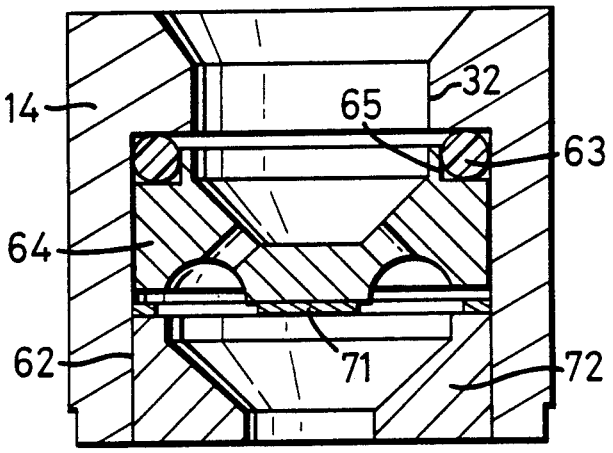
FIG. 4 is a cross-section of an injector nozzle assembly of a further form of fuel injector in which this invention is embodied.

FIG. 4 shows an arrangement which is similar to that described above with reference to FIG. 3 but which incorporates a bimetallic disc spring 71 instead of the tubular plastics bush 66. The outer peripheral portion of the disc spring 71 reacts against an end bush 72 which is fixed in the bore 62 at the end thereof remote from the bore 32. The central portion of the disc spring 71 acts on the nozzle body 64.

The disc spring 71 deforms from the flat planar state shown in FIG. 4 with increase in temperature of the fuel flowing passed it and/or increase in temperature of the portion of the body 14 surrounding it. It arches when it distorts with temperature increase, the central portion being displaced axially towards the bore 32, thus urging the nozzle body 64 towards the solenoid core 28 and reducing the stroke of the ball valve 41, as well as compressing the O-ring 63. The resilience of the O-ring 63 will cause the nozzle body 64 to return to the position shown in FIG. 4 on cooling of the fluid flow.

I claim:

1. An electromagnetically-operable fluid injector comprising a hollow body which carries an injector nozzle which forms a nozzle orfice, a chamber which is formed by the hollow interior of the body, a valve, a valve seat with which the value cooperates such that communication between the chamber and the nozzle orifice is allowed when the valve is unseated and is blocked when the valve is seated, a solenoid core which projects into the chamber opposite the valve seat, and a solenoid winding wound around the core, the valve being located in a gap in a magnetic circuit which is formed by the body, including the core, and which is magnetized by energization of the solenoid winding, wherein means which respond to changes in temperature to which they are subjected by changing a physical characteristic thereof, are provided in the injector so that they cooperate with one of the valve and the valve seat such that any tendency for fluid flow metering characteristics of the injector to be changed by a change in the temperature in the injector is countered whereby operation of the injector to inject fluid is substantially independent of temperature change;

wherein the stroke of movement of the valve relative to the valve seat is changed with a change in temperature by virtue of a consequent change in the physical form of said means which causes a change in the distance between the solenoid core and the valve seat; and wherein such variation in the stroke of the valve is achieved by the use of a telescopic assembly as the solenoid core, one part of the solenoid core nearer to the valve seat, being guided for rectilinear movement towards and away from the valve seat by a static part of the solenoid core, which is mounted in the hollow body, and being connected to the static part by a connecting piece of a material having a different coefficient of expansion from that of the material from which the static part is formed such that said one part is caused to move relative to said static part by the effects of the differential expansion of the connecting piece relative to the static part.

2. An electromagnetically-operable fluid injector according to claim 1, wherein the telescopic assembly is assembled with the connecting piece in compression.

3. An electromagnetically-operable fluid injector comprising a hollow body which carries an injector nozzle which forms a nozzle orifice, a chamber which is formed by the hollow interior of the body, a valve, a valve seat with which the valve cooperates such that communication between the chamber and the nozzle orifice is allowed when the valve is unseated and is blocked when the valve is seated, a solenoid core which projects into the chamber opposite the valve seat, and a solenoid winding wound around the core, the valve being located in a gap in a magnetic circuit which is formed by the body, including the core, and which is magnetized by energization of the solenoid winding, wherein means which respond to changes in temperature to which they are subjected by changing a physical characteristic thereof, are provided in the injector so that they cooperate with one of the valve and the valve seat such that any tendency for fluid flow metering characteristics of the injector to be changed by a change in the temperature in the injector is countered whereby operation of the injector to inject fluid is substantially independent of temperature change;

wherein the stroke of movement of the valve relative to the valve seat is changed with a change in temperature by virtue of a consequent change in the physical form of said means which causes a change in the distance between the solenoid core and the valve seat; and wherein such variation in the stroke of the valve is achieved by forming the valve seat on a member which is slidably mounted in the body and guided for rectilinear movement by the body relative to the solenoid core, the thermally-responsive means reacting against the body and acting on the member in opposition to the action of resilient means which provide a restoring force.

4. An electromagnetically-operable fluid injector according to claim 2, wherein the resilient means comprise an O-ring which surrounds the valve seat.

5. An electromagnetically-operable fluid injector according to claim 3, wherein the thermally-responsive means comprise a portion of plastics material having a suitable coefficient of expansion.

6. An electromagnetically-operable fluid injector according to claim 5, wherein the thermally-responsive means comprise a tubular bush which is arranged such that its bore forms a passage through which fluid that emerges from the nozzle orifice passes.

7. An electromagnetically-operable fluid injector according to claim 3, wherein the thermally-responsive means comprise a bimetallic element.

8. An electromagnetically-operable fluid injector according to claim 7, wherein the bimetallic element is a disc spring.

* * * * *